US010358900B1

(12) United States Patent
Fong

(10) Patent No.: US 10,358,900 B1
(45) Date of Patent: Jul. 23, 2019

(54) WELL PUMP SYSTEM

(71) Applicant: Mark Fong, Kearney, NE (US)

(72) Inventor: Mark Fong, Kearney, NE (US)

( * ) Notice: Subject to any disclaimer, the term of this patent is extended or adjusted under 35 U.S.C. 154(b) by 273 days.

(21) Appl. No.: 15/499,111

(22) Filed: Apr. 27, 2017

Related U.S. Application Data

(60) Provisional application No. 62/328,118, filed on Apr. 27, 2018.

(51) Int. Cl.

| | |
|---|---|
| ***E21B 43/12*** | (2006.01) |
| ***E21B 34/06*** | (2006.01) |
| ***E21B 17/042*** | (2006.01) |
| ***F04B 47/02*** | (2006.01) |

(52) U.S. Cl.
CPC ..... *E21B 43/126* (2013.01); *E21B 17/042* (2013.01); *E21B 34/06* (2013.01); *F04B 47/024* (2013.01)

(58) Field of Classification Search
CPC ..... E21B 43/126; E21B 43/127; E21B 34/06; E21B 17/042; F04B 47/06; F04D 13/086
See application file for complete search history.

(56) References Cited

U.S. PATENT DOCUMENTS

D314,039 S * 1/1991 Manchester ..... D23/231
2015/0184675 A1* 7/2015 Wilson ..... F04D 13/02 417/313

* cited by examiner

*Primary Examiner* — D. Andrews
*Assistant Examiner* — Ronald R Runyan
(74) *Attorney, Agent, or Firm* — Suiter Swantz pc llo

(57) ABSTRACT

A well pump system can include piping having an end positioned proximate to an entrance end of a borehole (e.g., a water well), and piping having an end positioned proximate to an opposing end of the borehole. A connector can couple the piping together, where the connector has ports for aligning the piping to form a longitudinal passage. The well pump system may further include a valve in the piping that can open and close the longitudinal passage with an actuator to be actuated from the entrance end of the borehole. A pump may be coupled to the piping, and a rod can be used to operate the pump. An end of the rod can be positioned between the opposing end of the borehole and the valve and connected to a second rod inserted through the longitudinal passage when the valve is open to operate the pump.

20 Claims, 9 Drawing Sheets

WELL PUMP SYSTEM

CROSS-REFERENCE TO RELATED APPLICATIONS

The present application claims the benefit under 35 U.S.C. § 119(e) of U.S. Provisional Application Ser. No. 62/328,118, filed Apr. 27, 2016, and titled "WELL PUMP SYSTEM," which is herein incorporated by reference in its entirety.

BACKGROUND

A water well is an excavation or structure that can be created in the ground by digging, driving, boring, and/or drilling to access groundwater (e.g., in an underground aquifer). Well water may be drawn from a well using a pump and/or containers.

SUMMARY

A well pump system can include piping having an end positioned proximate to an entrance end of a borehole (e.g., a water well), and piping having an end positioned proximate to an opposing end of the borehole. A connector can couple the piping together, where the connector has ports for aligning the piping to form a longitudinal passage. The well pump system may further include a valve in the piping that can open and close the longitudinal passage with an actuator to be actuated from the entrance end of the borehole. A pump may be coupled to the piping, and a rod can be used to operate the pump. An end of the rod can be positioned between the opposing end of the borehole and the valve and connected to a second rod inserted through the longitudinal passage when the valve is open to operate the pump.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. The use of the same reference numbers in different instances in the description and the figures may indicate similar or identical items.

DETAILED DESCRIPTION

Figure 1:
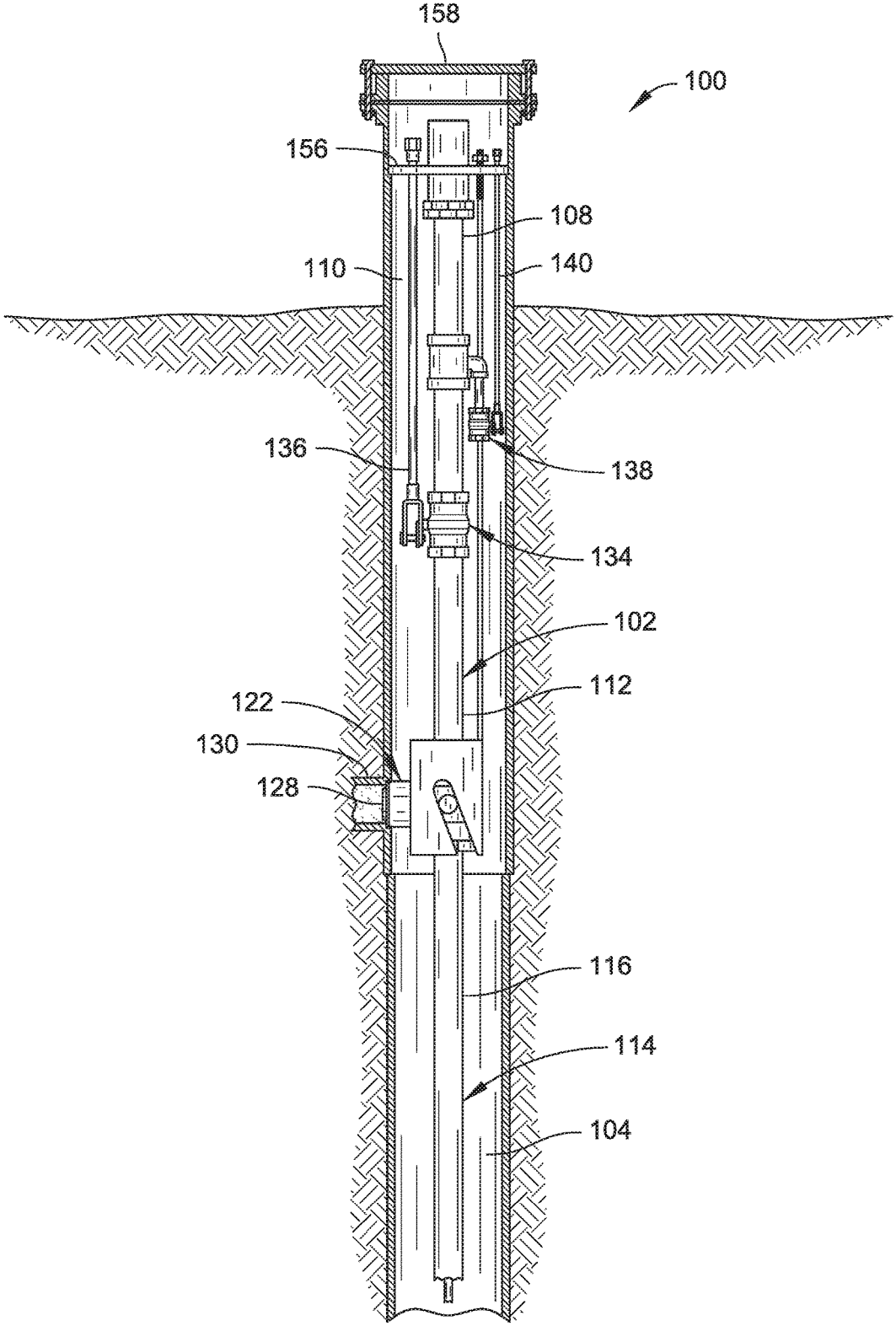
FIG. 1 is a partial side elevation view of a well pump system in accordance with an example embodiment of the present disclosure.
Figure 2:
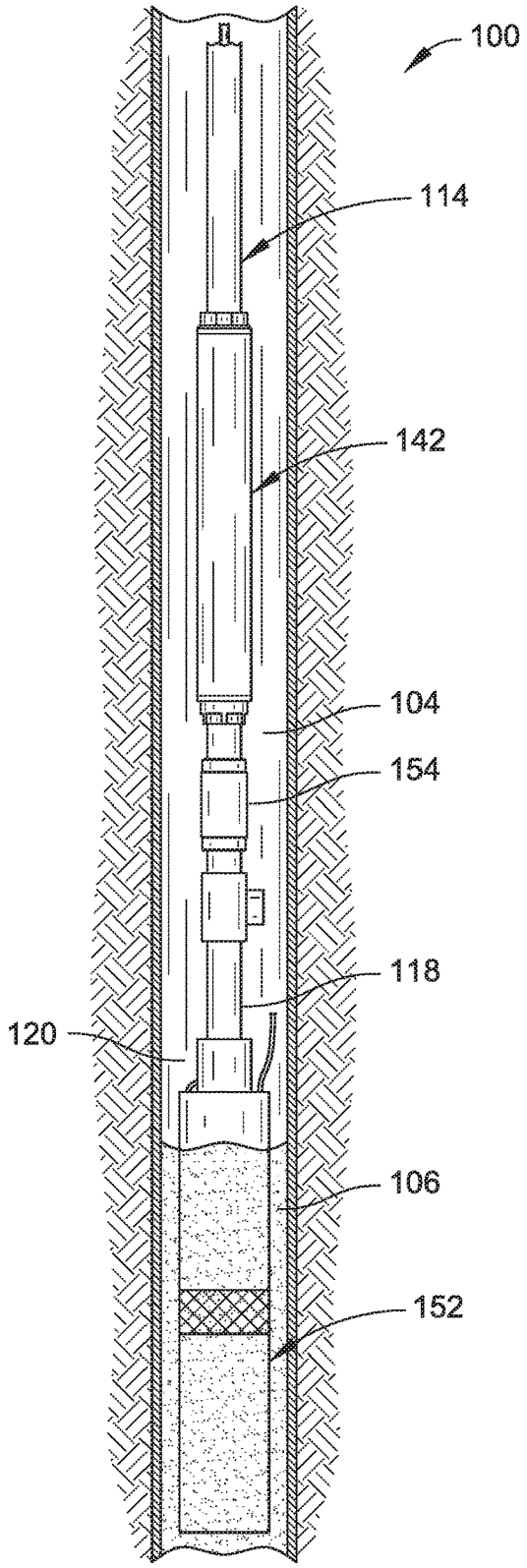
FIG. 2 is another partial side elevation view of the well pump system illustrated in FIG. 1.
Figure 3:
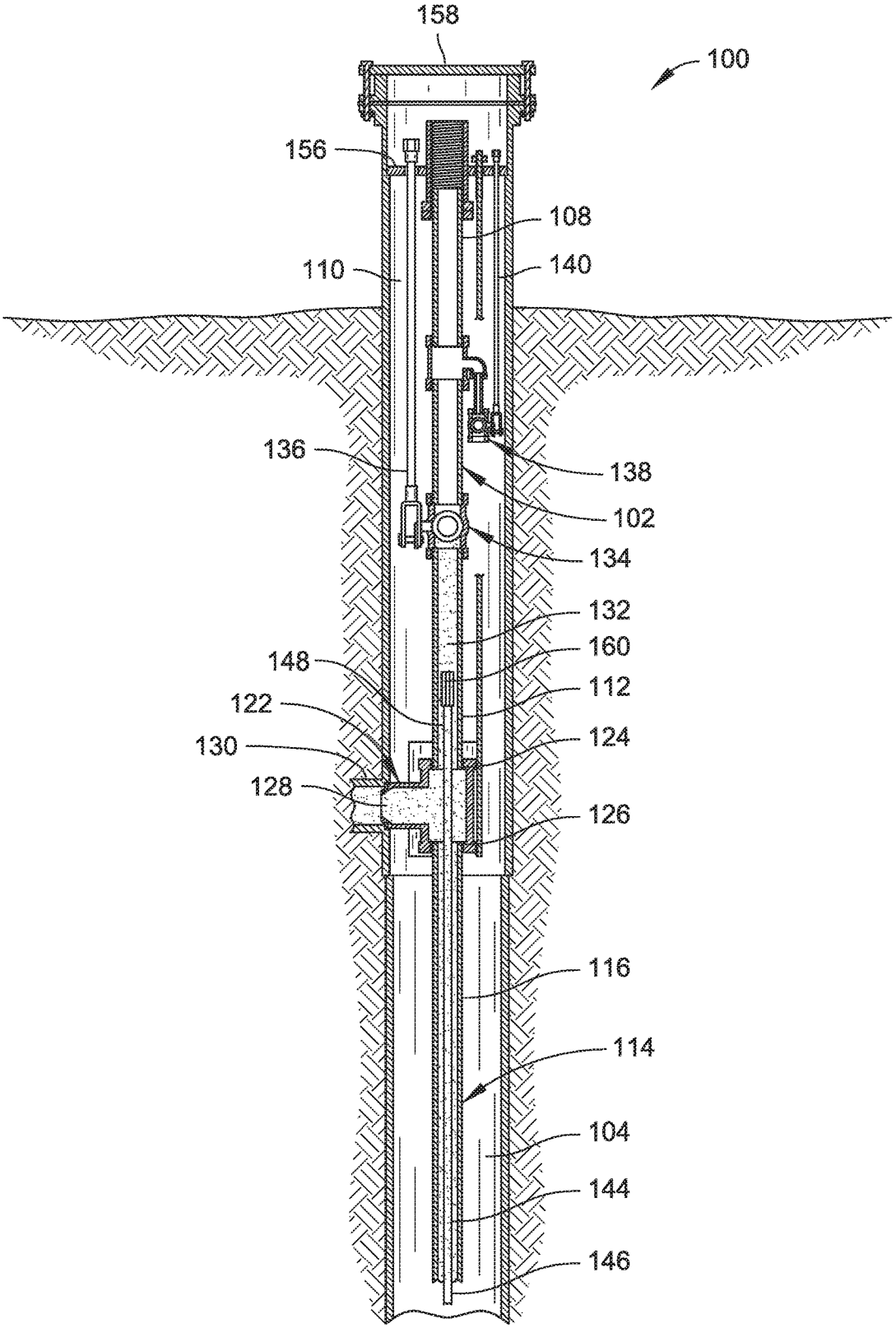
FIG. 3 is a partial cross-sectional side elevation view of a well pump system, such as the well pump system illustrated in FIG. 1, where a first valve is shown in a closed orientation in accordance with an example embodiment of the present disclosure.
Figure 4:
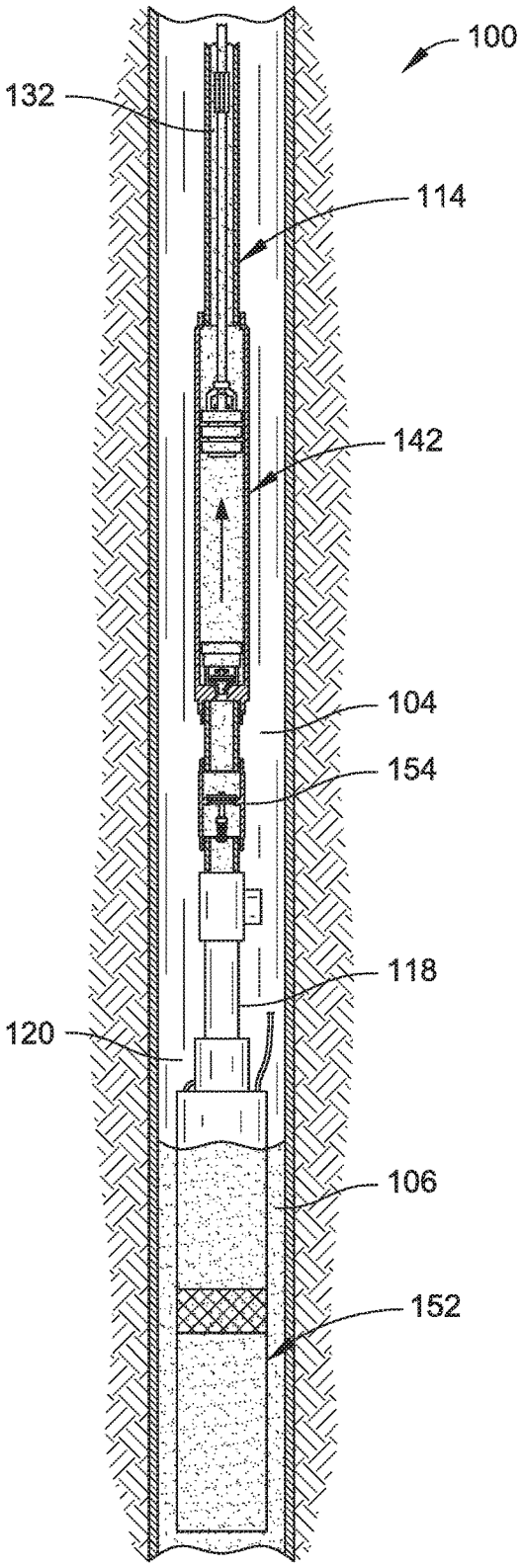
FIG. 4 is another partial cross-sectional side elevation view of the well pump system illustrated in FIG. 3.
Figure 5:
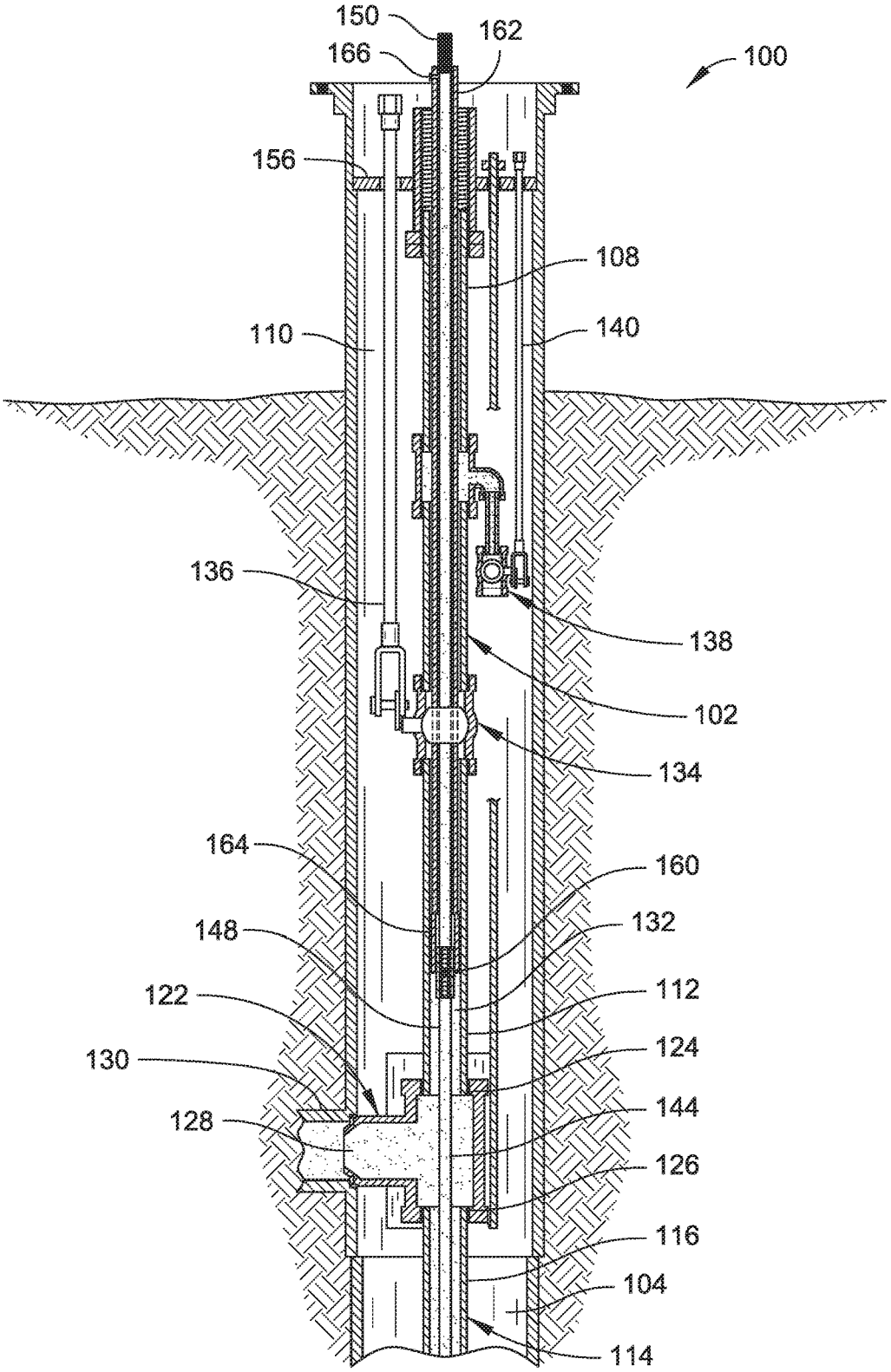
FIG. 5 is a partial cross-sectional side elevation view of a well pump system, such as the well pump system illustrated in FIG. 1, where a first valve is shown in an open orientation, and a first rod extending from a first pump is connected to a second rod that can reciprocate the first rod in accordance with an example embodiment of the present disclosure.
Figure 6:
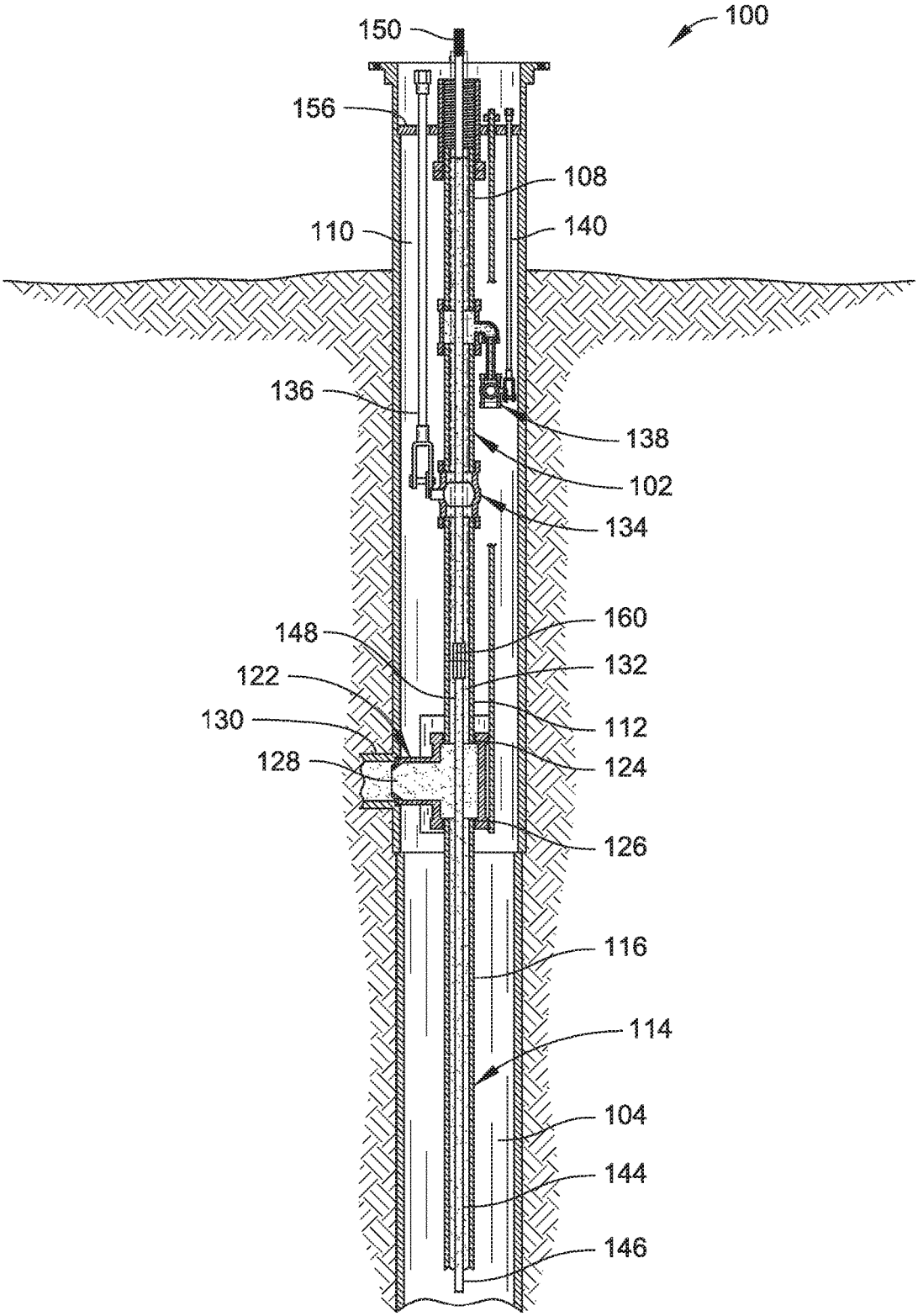
FIG. 6 is another partial cross-sectional side elevation view of the well pump system illustrated in FIG. 5.

Referring generally to FIGS. 1 through 9, a well pump system 100 is described. The well pump system 100 includes first piping 102 configured to extend into a borehole 104. In embodiments of the disclosure, the borehole 104 can be an excavation and/or a structure such as a water well, which is created in the ground by digging, driving, boring, and/or drilling to access groundwater 106 (e.g., in an underground aquifer). The first piping 102 has a first end 108 to be positioned proximate to an entrance end 110 of the borehole 104 (e.g., proximate to the surface) and a second end 112 opposite the first end 108. The well pump system 100 also includes second piping 114 configured to extend into the borehole 104. The second piping 114 has a first end 116 and a second end 118, where the second end 118 of the second piping 114 is positioned proximate to an opposing end 120 of the borehole 104 (e.g., proximate to the bottom of the water well).

The well pump system 100 also includes a connector 122 (e.g., a 'T'-fitting) configured to couple the first piping 102 to the second piping 114. The connector 122 has a first port 124 (e.g., a threaded port) for connecting to the first piping 102 and a second port 126 (e.g., another threaded port) for connecting to the second piping 114. In embodiments of the disclosure, the connector 122 also has a third port 128 that can be connected to, for example, third piping 130 routed to a facility (e.g., a residential facility, a business facility, an industrial facility, and so forth). In some embodiments, the third piping 130 can be connected to a pressure tank and/or one or more other water storage devices in the facility. The first port 124 and the second port 126 are configured to align the first piping 102 and the second piping 114 to form a longitudinal passage 132 that extends through the first piping 102 and the second piping 114.

In embodiments of the disclosure, the well pump system 100 also includes a first valve 134 in the first piping 102, where the first valve 134 is adjustable between a first orientation to open the longitudinal passage 132 through the first piping 102 and the second piping 114 (e.g., as described with reference to FIGS. 5 and 6), and a second orientation to close the longitudinal passage 132 (e.g., as described with reference to FIGS. 1 through 4 and 7). The first valve 134 can be, for example, a one-inch (1") ball valve. However, this valve is provided by way of example and is not meant to limit the present disclosure. In other embodiments, the first valve 134 can be a differently sized valve and/or another type of valve. In some embodiments, a first actuator 136 (e.g., a rod configured as a pull) can be connected to the first valve 134 and configured to be actuated from the entrance end 110 of the borehole 104 to open and close the first valve 134.

Figure 7:
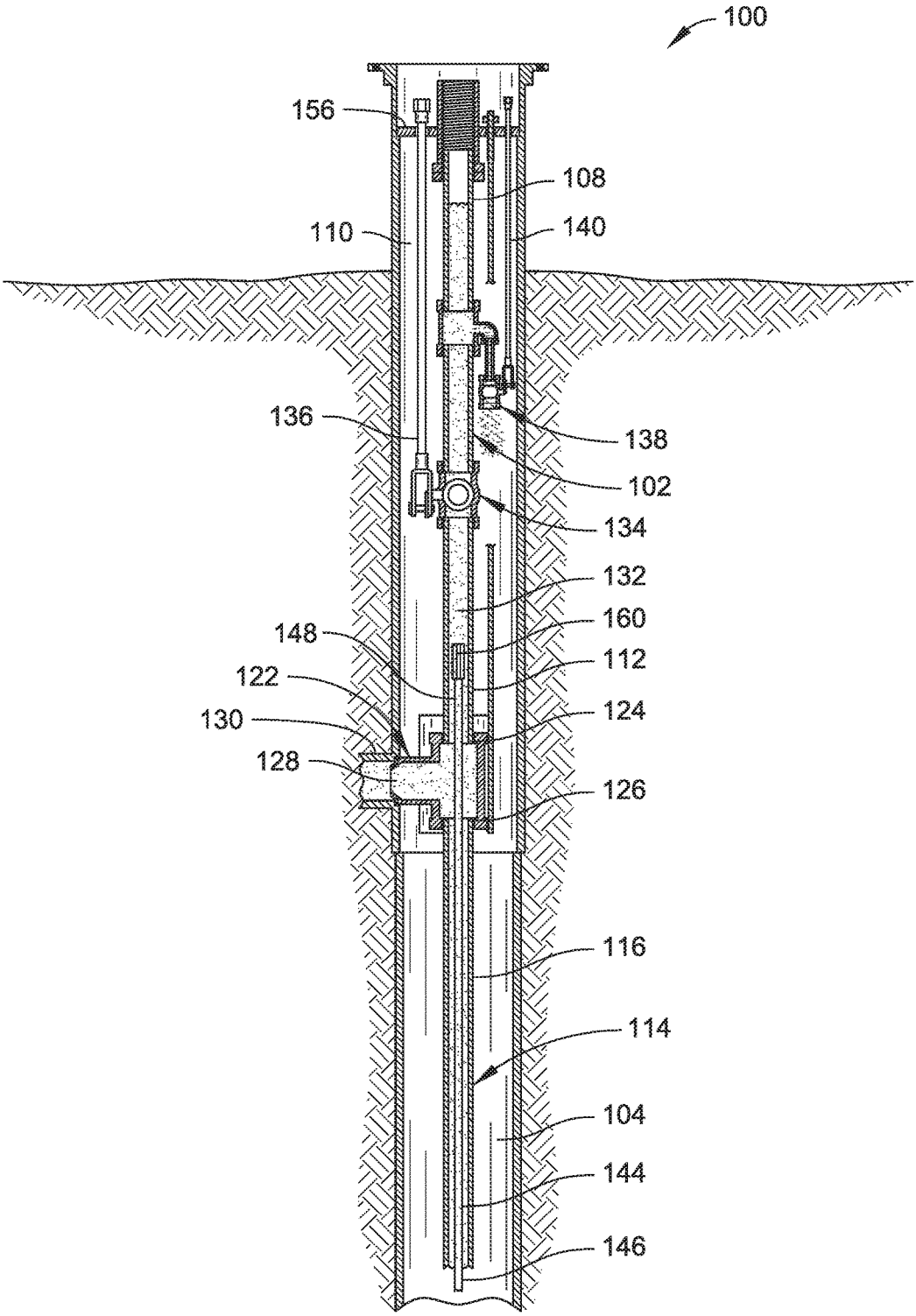
FIG. 7 is a partial cross-sectional side elevation view of a well pump system, such as the well pump system illustrated in FIG. 1, where a second valve is shown in an open orientation to bleed water from proximate to the surface back into the well in accordance with an example embodiment of the present disclosure.

The well pump system 100 may also include a second valve 138 in the first piping 102, where the second valve 138 is adjustable between a first orientation to open the longitudinal passage 132 to the borehole 104 (e.g., as described with reference to FIGS. 1 through 6), and a second orientation to close the longitudinal passage 132 to the borehole 104 (e.g., as described with reference to FIG. 7). The second valve 138 can be, for example, a one-eighth-inch (⅛") ball valve configured as a bleeder. However, this valve is provided by way of example and is not meant to limit the present disclosure. In other embodiments, the second valve 138 can be a differently sized valve and/or another type of valve. The second valve 138 can be used to bleed water from proximate to the surface back into the borehole 104. The second valve 138 may be positioned at or below, for instance, the frost line. In some embodiments, a second actuator 140 (e.g., a rod configured as a pull) can be connected to the second valve 138 and configured to be actuated from the entrance end 110 of the borehole 104 to open and close the second valve 138.

The well pump system 100 includes a first pump 142 to be coupled to the second piping 114 proximate to the opposing end 120 of the borehole 104. The first pump 142 can be, for example, a windmill water pumping cylinder. However, this pump is provided by way of example and is not meant to limit the present disclosure. In other embodiments, the first pump 142 can be another pump. In embodiments of the disclosure, a first rod 144 is configured to be reciprocated to operate the first pump 142, where the first rod 144 has a first end 146 connectable to the first pump 142 and a second end 148 extending from the first pump 142 toward the entrance end 110 of the borehole 104. In embodiments of the disclosure, the second end 148 of the first rod 144 is configured to be positioned between the opposing end 120 of the borehole 104 and the first valve 134. As described herein, the first rod 144 is connectable to a second rod 150 that can be inserted through the longitudinal passage 132 when the first valve 134 is open (e.g., as described with reference to FIGS. 5 and 6). The second rod 150 can be used to reciprocate the first rod 144 to operate the first pump 142.

In some embodiments, the first and second rods 144 and 150 can be connected together and used to pump with the first pump 142 in an emergency configuration. For example, the well pump system 100 may also include a second pump 152 connected in series with the first pump 142. In embodiments of the disclosure, the second pump 152 is operable to pump to the third port 128 of the connector 122 (e.g., when the first valve 134 is closed). The second pump 152 can be, for example, an electrically operated submersible well pump connected to the first pump 142 along the second piping 114. In the event of interruption of electrical power to the submersible pump (e.g., a power failure), the first and second rods 144 and 150 can be used to operate the first pump 142 (e.g., from the surface) and pump water through the second pump 152 (e.g., to the third piping 130 and/or to the surface). In some embodiments, a check valve 154 can be included between the first and second pumps 142 and 152.

In some embodiments, one or more seals can be provided for the first actuator 136, the second actuator 140, and/or the second rod 150 proximate to the top of the well pump system 100. For example, one or more sealing members (e.g., rubber grommets) can be included in a support 156 and/or a well cap 158, and the first actuator 136, the second actuator 140, and/or the first piping 102 can extend through the rubber grommets. The well cap 158 can be used to seal the well (and possibly the first end 108 of the first piping 102). In some embodiments, the well cap 158 can be removed to access the first and second actuators 136 and 140.

As described herein, the second end 148 of the first rod 144 can have a threaded coupler 160 (e.g., a hex coupler), and the second rod 150 can have a threaded end to be received in the threaded coupler 160. In order to fix the first rod 144 in place while the second rod 150 is screwed into the first rod 144, the second rod 150 can be inserted through a sleeve 162 having a socket 164 (e.g., a hex socket) configured to mate with the threaded coupler 160 of the first rod 144 (e.g., as described with reference to FIG. 5). By holding the sleeve 162 in place from the surface and preventing the sleeve 162 from rotating once the socket 164 has been mated with the threaded coupler 160, the second rod 150 may be turned from the surface to connect the threaded end of the second rod 150 into the threaded coupler 160. In some embodiments, a set screw 166 or another fastener can be included at an end of the sleeve 162 (e.g., to maintain the first and second rods 144 and 150 in threaded engagement).

In some embodiments, the first pump 142 and/or the second pump 152 can be operated based upon pressure in a water collection vessel connected to the third piping 130. For example, the second pump 152 is controlled by a pressure switch. When the pressure in a tank that stores the well water falls below a predetermined level, the second pump 152 can be actuated to pump water from the well. Once the pressure has reached a predetermined level, pumping from the second pump 152 can be stopped. Further, in some embodiments, the pressure tank may include a pre-charged bag and/or bladder that can moderate pressure in the piping of the well pump system 100.

In embodiments of the disclosure, the first pump 142 can also be connected to one or more pumping mechanisms, pressure sensors, switches, and so forth. For example, once the first and second rods 144 and 150 have been connected together, the second rod 150 can be connected to, for instance, a worm gear connected to a handle for manual pumping. The second rod 150 may also be connected to a pump jack with a seal over the second rod 150. In some embodiments, the seal may be disposed farther down the first piping 102, e.g., proximate to the connector 122. In this configuration, the well water is not necessarily pumped to the surface. Rather, the first pump 142 can be used to charge the pressure tank.

In some embodiments, the first pump 142 can be connected to a wind turbine, such as a vertical wind turbine. The wind turbine may be used to reciprocate the first and second rods 144 and 150. In this configuration, a brake may be used to slow or stop pumping of the first pump 142 (e.g., when the pressure in a tank that stores the well water has reached a predetermined level and/or when the wind has reached a predetermined speed). However, a brake is provided by way of example and is not meant to limit the present disclosure. In other embodiments, a different mechanism can be used to limit the pressure in a tank connected to the third piping 130, including, but not necessarily limited to a pop off valve, and so forth.

Figure 8:
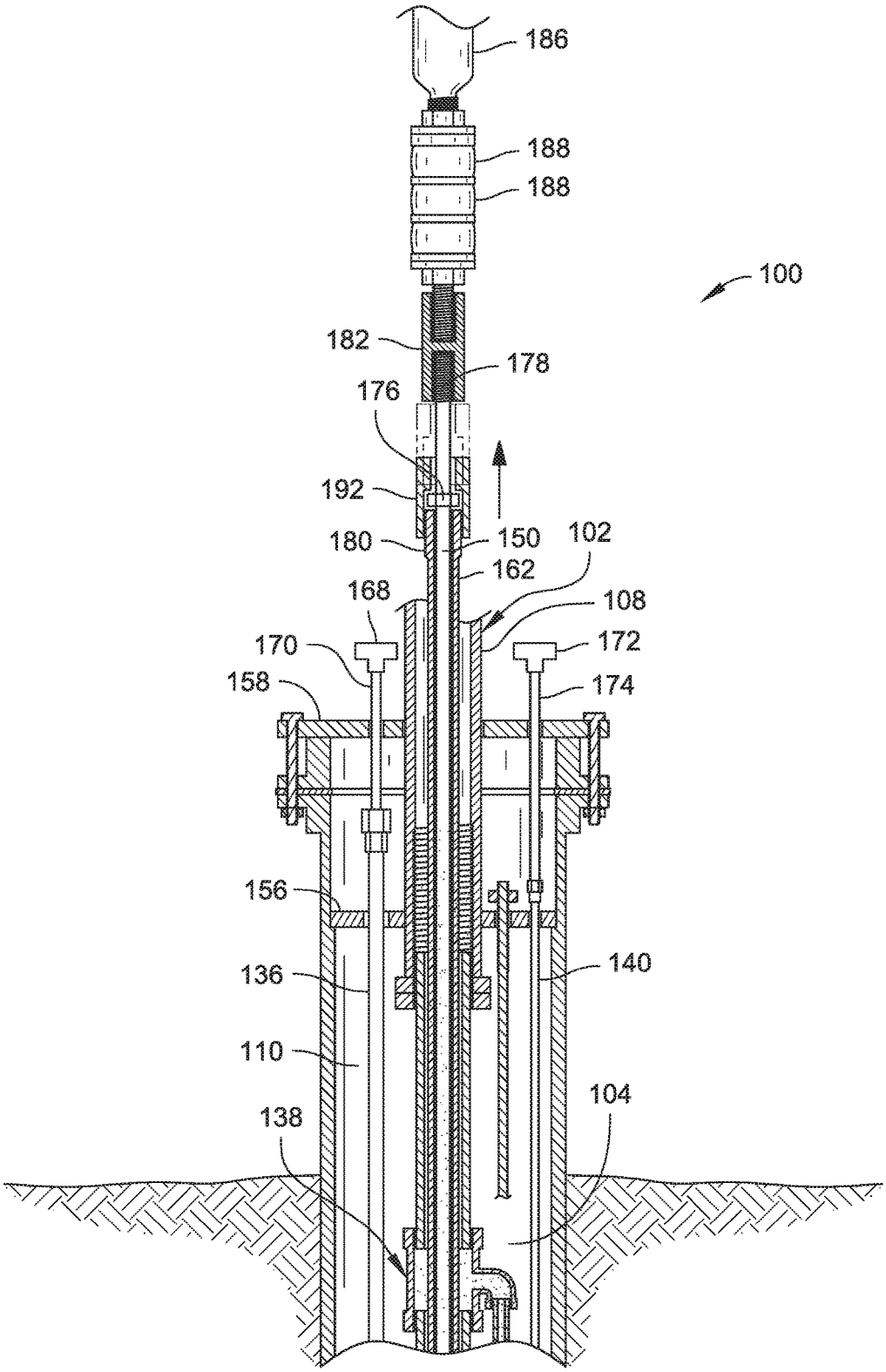
FIG. 8 is a partial cross-sectional side elevation view of a well pump system in accordance with an example embodiment of the present disclosure.
Figure 9:
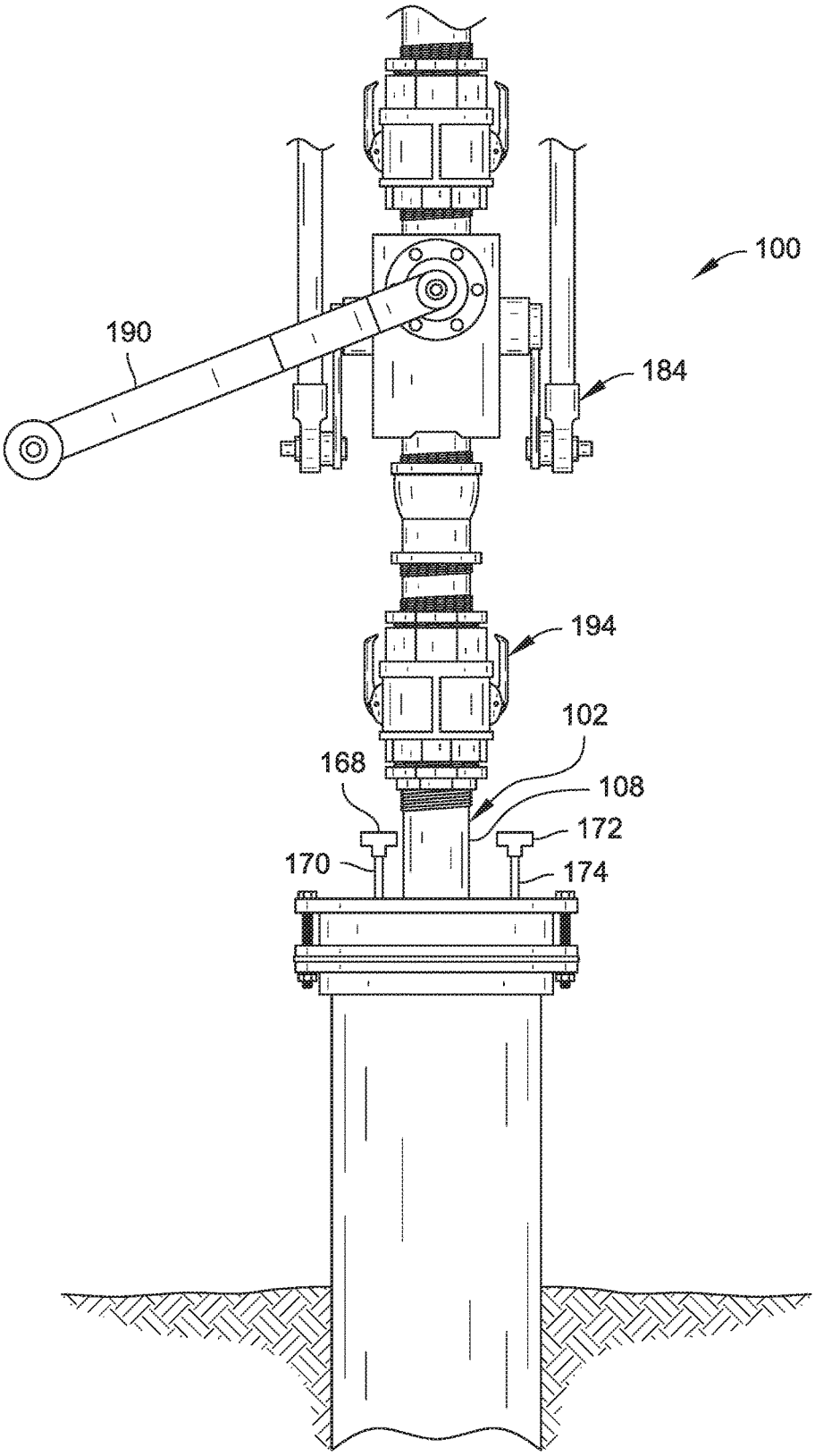
FIG. 9 is a partial side elevation view of the well pump system illustrated in FIG. 8.

Referring now to FIGS. 8 and 9, in some embodiments, the first actuator 136 can be connected to a handle 168 by, for example, an extension 170. Similarly, the second actuator 140 can be connected to another handle 172 by, for example, an extension 174. The extensions 170 and 174 can extend through the well cap 158 to actuate the first valve 134 and/or the second valve 138 from the entrance end 110 of the borehole 104. In other embodiments, the first actuator 136 and/or the second actuator 140 may extend through the well cap 158 to actuate the first valve 134 and/or the second valve 138. In this example, one or more of the actuators 136 and 140 may include a handle, such as the handles 168 and 172. Further, the first piping 102 may also extend through the well cap 158. In some embodiments, an extension to the first piping 102 may be used to extend the piping through the well cap 158. In some embodiments, one or more sealing members (e.g., rubber grommets) can be included in the support 156 and/or the well cap 158. The extension 170 (or the first actuator 136), the extension 174 (or the second actuator 140), and/or the first piping 102 (or an extension to the first piping 102) can extend through the rubber grommets.

In some embodiments, an end of the second rod 150 can include a nut 176 (e.g., a hex nut) fixed (e.g., welded) to the rod. An end of the second rod 150 can also include a threaded end 178. The sleeve 162 can have a coupler 180 (e.g., a hex coupler having the same diameter as the hex nut) at its end. The threaded end 178 of the second rod 150 can be threaded into a threaded connector 182, which can be connected to another threaded rod at the end of a mechanically operated pumping mechanism 184. For example, the pumping mechanism 184 can include a guide 186 for the pumping mechanism, leathers 188 to keep water from flowing out of the pumping mechanism, and so forth. The mechanically operated pumping mechanism 184 may include a handle 190 for actuating the pumping mechanism 184 (e.g., by hand) to reciprocate the first rod 144 to operate the first pump 142. Further, the mechanically operated pumping mechanism 184 may be connected to an actuation device, such as an electric motor, a gas-powered motor, a wind-driven motor, and so forth. In some embodiments, a socket 192 (e.g., a hex socket) can be mated with both the nut 176 and the coupler 180 to maintain the first and second rods 144 and 150 in threaded engagement (e.g., in place of or in addition to the set screw 166 described with reference to FIG. 5). In some embodiments, the pumping mechanism 184 can be securely connected to and at least partially supported by the first piping 102 or an extension to the first piping 102 using, for instance, a cam locking mechanism 194.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A well pump system comprising:

first piping configured to extend into a borehole, the first piping having an end to be positioned proximate to an entrance end of the borehole;

second piping configured to extend into the borehole, the second piping having an end to be positioned proximate to an opposing end of the borehole;

a connector configured to couple the first piping to the second piping, the connector having a first port for connecting to the first piping, a second port for connecting to the second piping, and a third port, the first port and the second port configured to align the first piping and the second piping to form a longitudinal passage that extends through the first piping and the second piping;

a first valve in the first piping, the first valve adjustable between a first orientation to open the longitudinal passage through the first piping and the second piping and a second orientation to close the longitudinal passage;

a first actuator connectable to the first valve and configured to be actuated from the entrance end of the borehole to open and close the first valve;

a first pump to be coupled to the second piping proximate to the opposing end of the borehole;

a first rod configured to be reciprocated to operate the first pump, the first rod having a first end connectable to the first pump and a second end to extend from the first pump toward the entrance end of the borehole, the second end of the first rod to be positioned between the opposing end of the borehole and the first valve, and configured to be connectable to a second rod to be inserted through the longitudinal passage when the first valve is open, the first rod including a threaded coupler to connect to the second rod; and a sleeve having a first socket configured to mate with the threaded coupler, the second rod configured to extend through the sleeve.

2. The well pump system as recited in claim 1, further comprising:

a second valve in the first piping, the second valve adjustable between a first orientation to open the longitudinal passage to the borehole and a second orientation to close the longitudinal passage to the borehole; and a second actuator connectable to the second valve and configured to be actuated from the entrance end of the borehole to open and close the second valve.

3. The well pump system as recited in claim 1, further comprising a second pump connected in series with the first pump, wherein the second pump is operable to pump to the third port of the connector when the first valve is closed.

4. The well pump system as recited in claim 3, wherein the threaded coupler comprises a hex coupler and the first socket comprises a hex socket.

5. The well pump system as recited in claim 3, wherein an end of the second rod comprises a nut fixedly connected to the second rod, the sleeve comprises a coupler, and the nut and the coupler can be mated together by a second socket.

6. The well pump system as recited in claim 5, wherein the nut comprises a hex nut, the coupler comprises a hex coupler, and the second socket comprises a hex socket.

7. A well pump system comprising:

first piping configured to extend into a borehole, the first piping having an end to be positioned proximate to an entrance end of the borehole;

second piping configured to extend into the borehole, the second piping having an end to be positioned proximate to an opposing end of the borehole;

a connector configured to couple the first piping to the second piping, the connector having a first port for connecting to the first piping, a second port for connecting to the second piping, and a third port, the first port and the second port configured to align the first piping and the second piping to form a longitudinal passage that extends through the first piping and the second piping;

a first valve in the first piping, the first valve adjustable between a first orientation to open the longitudinal passage through the first piping and the second piping and a second orientation to close the longitudinal passage;

a first actuator connectable to the first valve and configured to be actuated from the entrance end of the borehole to open and close the first valve;

a first pump to be coupled to the second piping proximate to the opposing end of the borehole;

a first rod configured to be reciprocated to operate the first pump, the first rod having a first end connectable to the first pump and a second end to extend from the first pump toward the entrance end of the borehole, the second end of the first rod to be positioned between the opposing end of the borehole and the first valve, and configured to be connectable to a second rod to be inserted through the longitudinal passage when the first valve is open;

a second valve in the first piping, the second valve adjustable between a first orientation to open the longitudinal passage to the borehole and a second orientation to close the longitudinal passage to the borehole; and a second actuator connectable to the second valve and configured to be actuated from the entrance end of the borehole to open and close the second valve.

8. The well pump system as recited in claim 7, further comprising a second pump connected in series with the first pump, wherein the second pump is operable to pump to the third port of the connector when the first valve is closed.

9. The well pump system as recited in claim 7, wherein the first rod includes a threaded coupler to connect to the second rod, and the well pump system further comprises a sleeve having a first socket configured to mate with the threaded coupler, the second rod configured to extend through the sleeve.

10. The well pump system as recited in claim 9, wherein the threaded coupler comprises a hex coupler and the first socket comprises a hex socket.

11. The well pump system as recited in claim 9, wherein an end of the second rod comprises a nut fixedly connected to the second rod, the sleeve comprises a coupler, and the nut and the coupler can be mated together by a second socket.

12. The well pump system as recited in claim 11, wherein the nut comprises a hex nut, the coupler comprises a hex coupler, and the second socket comprises a hex socket.

13. A well pump system comprising:

first piping configured to extend into a borehole, the first piping having an end to be positioned proximate to an entrance end of the borehole;

second piping configured to extend into the borehole, the second piping having an end to be positioned proximate to an opposing end of the borehole;

a connector configured to couple the first piping to the second piping, the connector having a first port for connecting to the first piping, a second port for connecting to the second piping, and a third port, the first port and the second port configured to align the first piping and the second piping to form a longitudinal passage that extends through the first piping and the second piping;

a first valve in the first piping, the first valve adjustable between a first orientation to open the longitudinal passage through the first piping and the second piping and a second orientation to close the longitudinal passage;

a first actuator connectable to the first valve and configured to be actuated from the entrance end of the borehole to open and close the first valve;

a first pump to be coupled to the second piping proximate to the opposing end of the borehole; and a first rod configured to be reciprocated to operate the first pump, the first rod having a first end connectable to the first pump and a second end to extend from the first pump toward the entrance end of the borehole, the second end of the first rod to be positioned between the opposing end of the borehole and the first valve, and configured to be connectable to a second rod to be inserted through the longitudinal passage when the first valve is open.

14. The well pump system as recited in claim 13, further comprising:

a second valve in the first piping, the second valve adjustable between a first orientation to open the longitudinal passage to the borehole and a second orientation to close the longitudinal passage to the borehole; and a second actuator connectable to the second valve and configured to be actuated from the entrance end of the borehole to open and close the second valve.

15. The well pump system as recited in claim 13, further comprising a second pump connected in series with the first pump, wherein the second pump is operable to pump to the third port of the connector when the first valve is closed.

16. The well pump system as recited in claim 13, wherein the first rod includes a threaded coupler to connect to the second rod.

17. The well pump system as recited in claim 16, wherein the well pump system further comprises a sleeve having a first socket configured to mate with the threaded coupler, the second rod configured to extend through the sleeve.

18. The well pump system as recited in claim 17, wherein the threaded coupler comprises a hex coupler and the first socket comprises a hex socket.

19. The well pump system as recited in claim 17, wherein an end of the second rod comprises a nut fixedly connected to the second rod, the sleeve comprises a coupler, and the nut and the coupler can be mated together by a second socket.

20. The well pump system as recited in claim 19, wherein the nut comprises a hex nut, the coupler comprises a hex coupler, and the second socket comprises a hex socket.

* * * * *